US012501993B2

(12) United States Patent
Braman et al.

(10) Patent No.: US 12,501,993 B2
(45) Date of Patent: Dec. 23, 2025

(54) TOWEL CLIP AND STORAGE DEVICE

(71) Applicants: Michael Braman, Dowagiac, MI (US); Dirk Brown, Schererville, IN (US)

(72) Inventors: Michael Braman, Dowagiac, MI (US); Dirk Brown, Schererville, IN (US)

( * ) Notice: Subject to any disclaimer, the term of this patent is extended or adjusted under 35 U.S.C. 154(b) by 250 days.

(21) Appl. No.: 18/382,437

(22) Filed: Oct. 20, 2023

(65) Prior Publication Data

US 2025/0127284 A1 Apr. 24, 2025

(51) Int. Cl.
*A45F 5/00* (2006.01)

(52) U.S. Cl.
CPC ..... *A45F 5/00* (2013.01); *A45F 2005/002* (2013.01)

(58) Field of Classification Search
CPC .. A45F 5/02; A45F 5/021; A45F 5/022; A45F 2005/002
USPC ..... D8/395; 224/587, 269; 150/137
See application file for complete search history.

(56) References Cited

U.S. PATENT DOCUMENTS

| | | | | |
|---|---|---|---|---|
| 3,956,805 | A * | 5/1976 | Stroh | A41F 15/02 24/489 |
| 5,103,884 | A * | 4/1992 | Roman | A45C 1/04 224/667 |
| 5,115,909 | A * | 5/1992 | Hull | A45C 1/06 150/137 |
| 5,718,329 | A * | 2/1998 | Ippolito | A45C 11/182 150/147 |
| 6,405,415 | B1 | 6/2002 | Meeks | |
| 7,318,293 | B2 * | 1/2008 | Ardern, II | G09F 7/02 40/658 |
| D591,044 | S | 4/2009 | Lakhiani | |
| 7,963,010 | B2 | 6/2011 | Levesque | |
| 9,402,483 | B2 | 8/2016 | Kaalberg | |
| D794,437 | S | 8/2017 | Zinser | |
| 11,168,964 | B2 * | 11/2021 | Finsand | F42B 39/02 |
| 2008/0178976 | A1 * | 7/2008 | Lakhiani | A45C 1/06 150/147 |
| 2016/0338504 | A1 | 11/2016 | Bellini | |
| 2017/0079485 | A1 | 3/2017 | Johnson | |
| 2017/0303614 | A1 | 10/2017 | McMahon | |

FOREIGN PATENT DOCUMENTS

| | | |
|---|---|---|
| WO | WO2010139227 | 9/2010 |

* cited by examiner

*Primary Examiner* — Justin M Larson

(57) ABSTRACT

A towel clip and storage device for storing personal objects on a towel includes a clip that has a first panel which is biased against a second panel. The clip engages a towel that is wrapped around a user's waist having the towel being compressed between the first panel and the second panel for retaining the towel around the user's waist. A pocket is coupled to the first panel which can contain personal objects of the user. The pocket is strategically positioned on the first panel such that the pocket is positioned between the first panel and the towel when the clip is positioned on the towel thereby concealing the personal objects from view.

7 Claims, 4 Drawing Sheets

TOWEL CLIP AND STORAGE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to towel clip devices and more particularly pertains to a new towel clip device for storing personal objects on a towel. The device includes a clip comprising a first panel that is biased to lie against a second panel. The clip is positionable on a towel that is worn on a user's waist such that the towel is compressed between the first panel and the second panel for retaining the towel on the user's waist. The device includes a pocket that is strategically positioned on the first panel for concealing personal objects between the first panel and the towel.

(2) Description of Related Art Including Information Disclosed Under 37 CFR 1.97 and 1.98

The prior art relates to towel clip devices including a variety of towel clip devices that are each uniquely structured to firmly grip a towel for retaining the towel around a user. In no instance does the prior art disclose a towel clip device that includes a pocket for discretely storing personal objects of the user.

BRIEF SUMMARY OF THE INVENTION

An embodiment of the disclosure meets the needs presented above by generally comprising a clip that has a first panel which is biased against a second panel. The clip engages a towel that is wrapped around a user's waist having the towel being compressed between the first panel and the second panel for retaining the towel around the user's waist. A pocket is coupled to the first panel which can contain personal objects of the user. The pocket is strategically positioned on the first panel such that the pocket is positioned between the first panel and the towel when the clip is positioned on the towel thereby concealing the personal objects from view.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
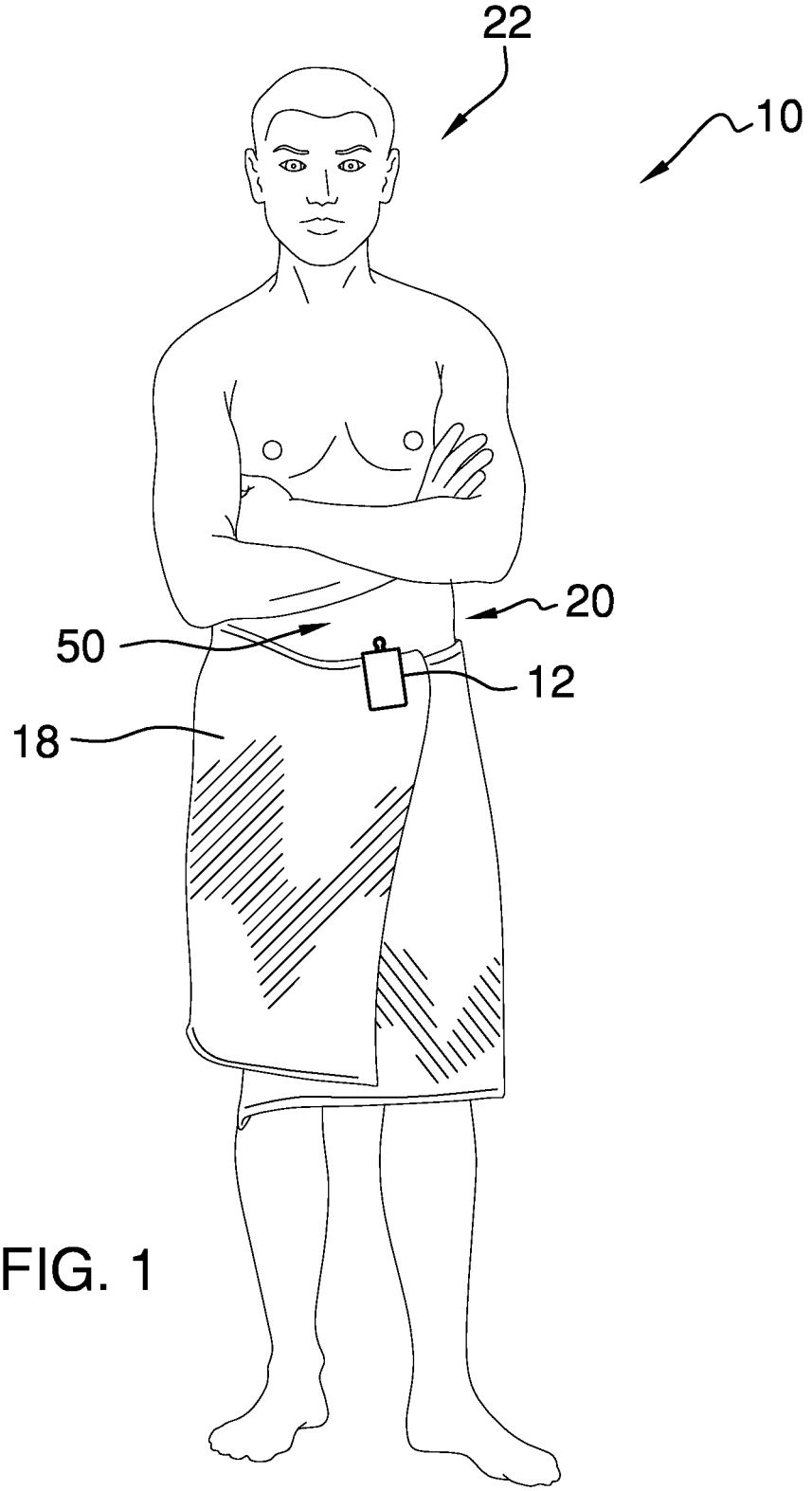
FIG. 1 is a perspective in-use view of a towel clip and storage device according to an embodiment of the disclosure.
Figure 2:
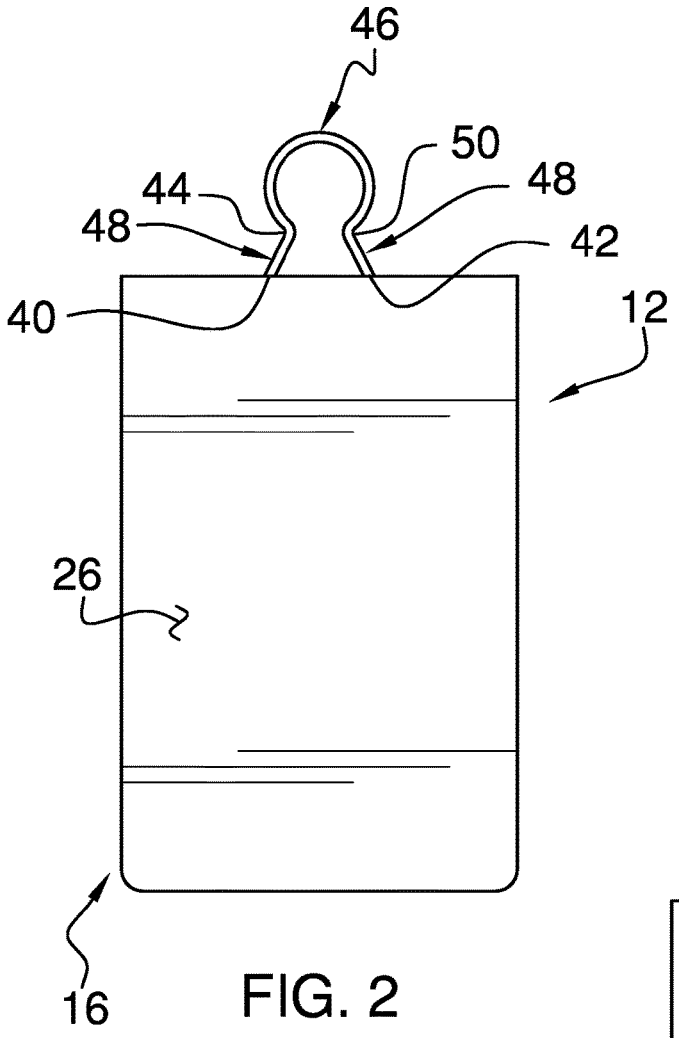
FIG. 2 is a back view of an embodiment of the disclosure.
Figure 3:
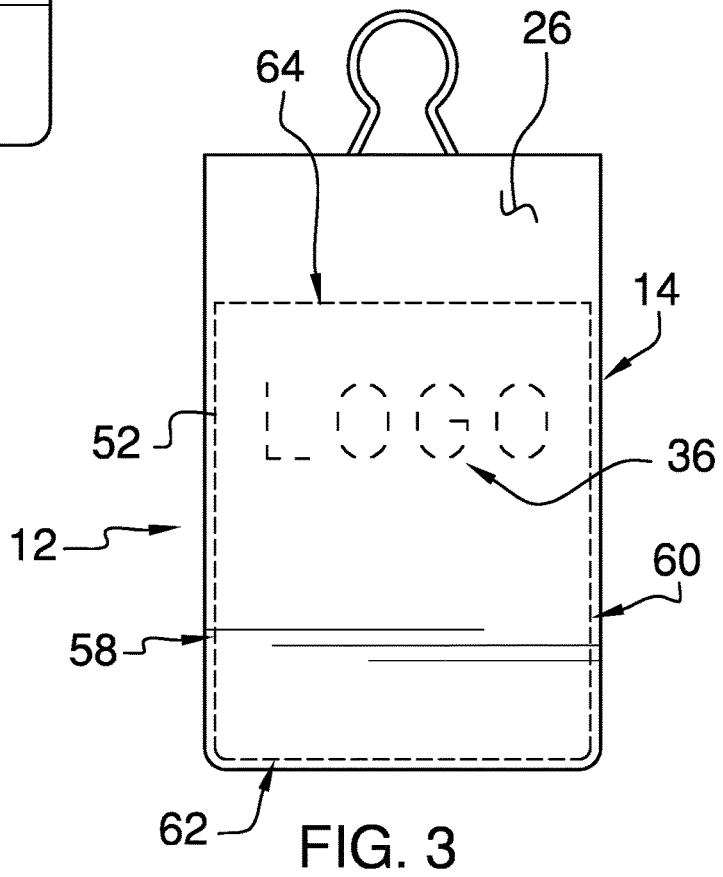
FIG. 3 is a front phantom view of an embodiment of the disclosure.
Figure 4:
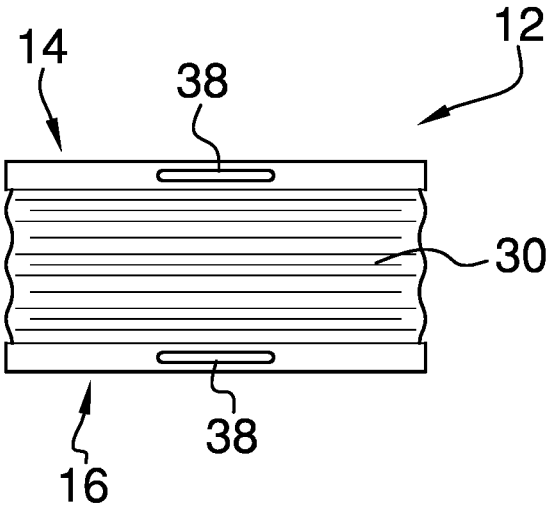
FIG. 4 is a top view of an embodiment of the disclosure.
Figure 5:
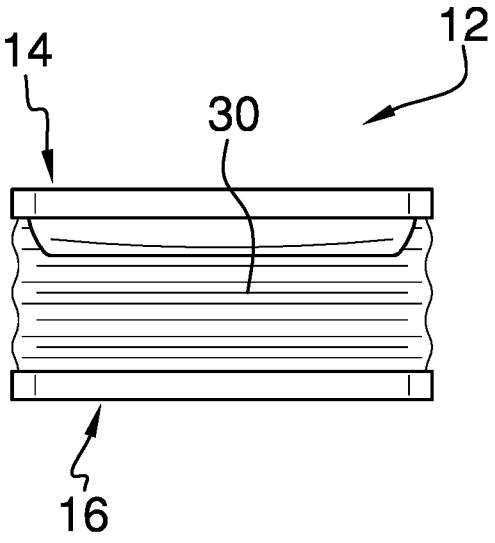
FIG. 5 is a bottom view of an embodiment of the disclosure.
Figure 6:
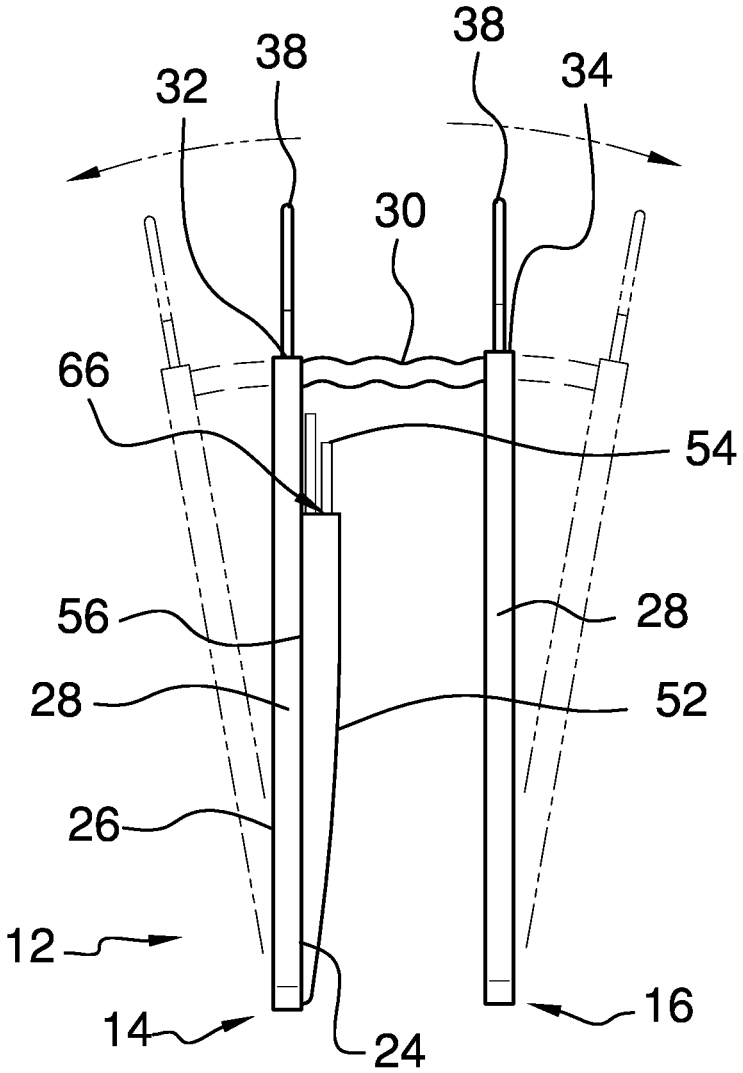
FIG. 6 is a left side view of an embodiment of the disclosure.

With reference now to the drawings, and in particular to FIGS. 1 through 6 thereof, a new towel clip device embodying the principles and concepts of an embodiment of the disclosure and generally designated by the reference numeral 10 will be described.

As best illustrated in FIGS. 1 through 6, the towel clip and storage device 10 generally comprises a clip 12 that has a first panel 14 which is biased against a second panel 16 to engage a towel 18 that is wrapped around a waist 20 of a user 22. The towel 18 is compressed between the first panel 14 and the second panel 16 for retaining the towel 18 around the user's waist 20. The towel 18 may be a beach towel, a bath towel or any other type of towel that the user 22 might wear around their waist 20 at a beach, for example. Each of the first panel 14 and the second panel 16 has a first surface 24, a second surface 26 and a perimeter edge 28 extending between the first surface 24 and the second surface 26. The clip 12 includes an elastomeric member 30 extending between the first surface 24 of the first panel 14 and the first surface 24 of the second panel 16 thereby biasing the first surface 24 of the first panel 14 to abut the first surface 24 of the second panel 16. Furthermore, the elastomeric member 30 is aligned with a top side 32 of the perimeter edge 28 of the first panel 14 and a top side 34 of the perimeter edge 28 of the second panel 16. Indicia 36 may be applied to the second surface 26 of the first panel 14 and the indicia 36 may comprise a logo of a business or a sports team or any other ornamental design.

A pair of handles 38 is provided and each of the handles 38 has a first end 40 and a second end 42 and each of the pair of handles 38 has a pair of bends 44 each being spaced from a respective one of the first end 40 and the second end 42. Each of the pair of handles 38 has a curved portion 46 extending between the pair of bends 44 and a pair of legs 48 each extending between a respective one of the pair of bends 44 and a respective one of the first end 40 and the second end 42. Furthermore, the pair of legs 48 on a respective one of the handles 38 angles away from each other such that each of the pair of handles 38 has a keyhole shape. Each of the first end 40 and the second end 42 of a respective one of the pair of handles 38 is coupled to the top side 32 of the perimeter edge 28 of the first panel 14. Additionally, each of the first end 40 and the second end 42 of a respective one of the pair of handles 38 is coupled to the top side 34 of the perimeter edge 28 of the second panel 16. Furthermore, each of the pair of handles 38 can be manipulated to urge the first panel 14 away from the second panel 16 to place the clip 12 on the towel 18. Each of the first end 40 and the second end 42 of each of the pair of handles 38 may be pivotally mounted to the respective first panel 14 and second panel 16 to facilitate the handles 38 to be folded over such that the handles 38 do not push into the user's body 50 when the user 22 sits down or bends 44 over.

A pocket 52 is coupled to the first panel 14 and the pocket 52 can contain personal objects 54 of the user 22, including but not being limited to, a driver's license or a credit card. The pocket 52 is strategically positioned on the first panel 14 such that the pocket 52 is be positioned between the first panel 14 and the towel 18 when the clip 12 is positioned on the towel 18. In this way the personal objects 54 are concealed from view of a potential thief. The pocket 52 has an exterior edge 56 which has a first lateral side 58, a second lateral side 60, a bottom side 62 and a top side 64. Each of the first lateral side 58, the second lateral side 60 and the bottom side 62 is attached to the first surface 24 of the first panel 14. The top side 64 of the exterior edge 56 is free from the first surface 24 to define an opening 66 into the pocket 52 to receive the personal objects 54. Additionally, the pocket 52 is oriented on the first surface 24 such that the top side 64 of the exterior edge 56 is spaced from and is oriented parallel to the elastomeric member 30.

In use, the towel 18 is wrapped around the user's waist 20 and the clip 12 is positioned on the towel 18 where the towel 18 overlaps itself to secure the towel 18 in place around the user's waist 20. In this way the user 22 can walk and move around without having to manually hold the towel 18 in place. Furthermore, the user 22 can place their personal objects 54 in the pocket 52 thereby facilitating the personal objects 54 to be stored and carried when the user 22 is wearing swimming shorts, for example, or other article of clothing that does not have pockets. The personal objects 54 are positioned between the first panel 14 and the towel 18 thereby facilitating the personal objects 54 to be concealed from a potential thief.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A towel clip and storage device for securing a towel around a user's waist while storing personal objects belonging to the user, said device comprising:

a clip having a first panel being biased against a second panel wherein said clip is configured to engage a towel that is wrapped around a user's waist having the towel being compressed between said first panel and said second panel for retaining the towel around the user's waist; and a pocket being coupled to said first panel wherein said pocket is configured to contain personal objects of the user, said pocket being strategically positioned on said first panel between said first panel and said second panel wherein said pocket is configured to be positioned between said first panel and the towel when said clip is positioned on the towel thereby concealing the personal objects from view.

2. The device according to claim 1, wherein:

each of said first panel and said second panel has a first surface, a second surface and a perimeter edge extending between said first surface and said second surface;

said clip includes an elastomeric member extending between said first surface of said first panel and said first surface of said second panel thereby biasing said first surface of said first panel to abut said first surface of said second panel; and said elastomeric member is aligned with a top side of said perimeter edge of said first panel and a top side of said perimeter edge of said second panel.

3. The device according to claim 2, wherein:

said device includes a pair of handles, each of said handles having a first end and a second end;

each of said pair of handles has a pair of bends each being spaced from a respective one of said first end and said second end;

each of said pair of handles has a curved portion extending between said pair of bends and a pair of legs each extending between a respective one of said pair of bends and a respective one of said first end and said second end;

said pair of legs on a respective one of said handles angles away from each other such that each of said pair of handles has a keyhole shape;

each of said first end and said second end of a respective one of said pair of handles is coupled to said top side of said perimeter edge of said first panel; and each of said first end and said second end of a respective one of said pair of handles being coupled to said top side of said perimeter edge of said second panel wherein each of said pair of handles is configured to be manipulated to urge said first panel away from said second panel to place said clip on the towel.

4. The device according to claim 2, wherein:

said pocket has an exterior edge having a first lateral side and a second lateral side and a bottom side and a top side;

each of said first lateral side and said second lateral side and said bottom side is attached to said first surface of said first panel; and said top side of said exterior edge is free from said first surface to define an opening into said pocket wherein said opening is configured to receive the personal objects.

5. The device according to claim 4, wherein said pocket is oriented on said first surface such that said top side of said exterior edge is spaced from and is oriented parallel to said elastomeric member.

6. A towel clip and storage device for securing a towel around a user's waist while storing personal objects belonging to the user, said device comprising:

a clip having a first panel being biased against a second panel wherein said clip is configured to engage a towel that is wrapped around a user's waist having the towel being compressed between said first panel and said second panel for retaining the towel around the user's waist, each of said first panel and said second panel having a first surface, a second surface and a perimeter edge extending between said first surface and said second surface, said clip including an elastomeric member extending between said first surface of said first panel and said first surface of said second panel thereby biasing said first surface of said first panel to abut said first surface of said second panel, said elastomeric member being aligned with a top side of said perimeter edge of said first panel and a top side of said perimeter edge of said second panel;

a pair of handles, each of said handles having a first end and a second end, each of said pair of handles having a pair of bends each being spaced from a respective one of said first end and said second end, each of said pair of handles having a curved portion extending between said pair of bends and a pair of legs each extending between a respective one of said pair of bends and a respective one of said first end and said second end, said pair of legs on a respective one of said handles angling away from each other such that each of said pair of handles has a keyhole shape, each of said first end and said second end of a respective one of said pair of handles being coupled to said top side of said perimeter edge of said first panel, each of said first end and said second end of a respective one of said pair of handles being coupled to said top side of said perimeter edge of said second panel wherein each of said pair of handles is configured to be manipulated to urge said first panel away from said second panel to place said clip on the towel; and a pocket being coupled to said first panel wherein said pocket is configured to contain personal objects of the user, said pocket being strategically positioned on said first panel wherein said pocket is configured to be positioned between said first panel and the towel when said clip is positioned on the towel thereby concealing the personal objects from view, said pocket having an exterior edge having a first lateral side and a second lateral side and a bottom side and a top side, each of said first lateral side and said second lateral side and said bottom side being attached to said first surface of said first panel, said top side of said exterior edge being free from said first surface to define an opening into said pocket wherein said opening is configured to receive the personal objects, said pocket being oriented on said first surface such that said top side of said exterior edge is spaced from and is oriented parallel to said elastomeric member.

7. A towel clip and storage system for securing a towel around a user's waist while storing personal objects belonging to the user, said system comprising:

a towel being wearable around a user's waist;

a clip having a first panel being biased against a second panel thereby facilitating said clip to engage said towel having said towel being compressed between said first panel and said second panel for retaining said towel around the user's waist, each of said first panel and said second panel having a first surface, a second surface and a perimeter edge extending between said first surface and said second surface, said clip including an elastomeric member extending between said first surface of said first panel and said first surface of said second panel thereby biasing said first surface of said first panel to abut said first surface of said second panel, said elastomeric member being aligned with a top side of said perimeter edge of said first panel and a top side of said perimeter edge of said second panel;

a pair of handles, each of said handles having a first end and a second end, each of said pair of handles having a pair of bends each being spaced from a respective one of said first end and said second end, each of said pair of handles having a curved portion extending between said pair of bends and a pair of legs each extending between a respective one of said pair of bends and a respective one of said first end and said second end, said pair of legs on a respective one of said handles angling away from each other such that each of said pair of handles has a keyhole shape, each of said first end and said second end of a respective one of said pair of handles being coupled to said top side of said perimeter edge of said first panel, each of said first end and said second end of a respective one of said pair of handles being coupled to said top side of said perimeter edge of said second panel wherein each of said pair of handles is configured to be manipulated to urge said first panel away from said second panel to place said clip on said towel; and a pocket being coupled to said first panel wherein said pocket is configured to contain personal objects of the user, said pocket being strategically positioned on said first panel such that said pocket is positioned between said first panel and said towel when said clip is positioned on said towel wherein said pocket is configured to conceal the personal objects from view, said pocket having an exterior edge having a first lateral side and a second lateral side and a bottom side and a top side, each of said first lateral side and said second lateral side and said bottom side being attached to said first surface of said first panel, said top side of said exterior edge being free from said first surface to define an opening into said pocket wherein said opening is configured to receive the personal objects, said pocket being oriented on said first surface such that said top side of said exterior edge is spaced from and is oriented parallel to said elastomeric member.

* * * * *